US006308415B1

(12) United States Patent
Sablatschan et al.

(10) Patent No.: US 6,308,415 B1
(45) **Date of Patent: *Oct. 30, 2001**

(54) HAIR-CUTTING APPARATUS HAVING A TOOTHED CUTTING DEVICE, AND TOOTHED CUTTING DEVICE FOR A HAIR-CUTTING APPARATUS

(75) Inventors: Siegfried Sablatschan; Manfred Tautscher, both of Ferlach (AT)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/065,967

(22) Filed: Apr. 24, 1998

(30) Foreign Application Priority Data

Apr. 24, 1997 (EP) ..... 97890076

(51) Int. Cl.[7] ..... B26B 19/06
(52) U.S. Cl. ..... 30/43.92; 30/224
(58) Field of Search ..... 30/43.2, 43.1, 30/43.92, 43.91, 43.9, 42, 222, 224

(56) References Cited

U.S. PATENT DOCUMENTS 1,332,553 * 3/1920 Halterman ..... 30/43.2 X
1,682,447 * 8/1928 Van Osdel ..... 30/43.1 X
1,835,613 * 12/1931 Perlman ..... 30/43.92 X
1,997,768 * 4/1935 Dreverhoff ..... 30/43.92 X
2,029,791 * 2/1936 Pluchino ..... 30/43.92 X
2,704,887 * 3/1955 Andis .
3,052,025 * 9/1962 Ring .
3,729,821 * 5/1973 Voight et al. .
4,989,324 * 2/1991 Andis .
5,068,966 * 12/1991 Wahl et al. ..... 30/43.2
5,088,200 * 2/1992 Piwaron et al. .
5,170,563 * 12/1992 Van Der Grijn .
5,325,590 * 7/1994 Andis et al. .

FOREIGN PATENT DOCUMENTS

2646818A1 5/1977 (DE) .

* cited by examiner

*Primary Examiner*—Kenneth E. Peterson
(74) *Attorney, Agent, or Firm*—Ernestine C. Bartlett; Norman N. Spain

(57) ABSTRACT

In a hair-cutting apparatus (1) and in a toothed cutting device (7) for a hair-cutting apparatus (1) the toothed cutting device (7) comprises a first toothed cutter (13) and a second toothed cutter (24), which lie against one another in the area of their cuttertooth rows (18, 25) and which each have at least one supporting limb (20, 21, 46, 47) in their areas which are remote from their cutter-tooth rows (18, 25), and of which one toothed cutter (24) carries an intermediate element (48) of a low-friction material, which comprises at least one intermediate element portion (49, 50) interposed between two facing supporting limbs (20, 46, 21, 47), and furthermore it has the advantageous feature that the at least one intermediate element portion (49, 50) of the intermediate element (48) carried by the one toothed cutter (24) has a smaller dimension in the toothed cutter direction (17) than the at least one supporting limb (20, 21) of the other toothed cutter (13), which last-mentioned limb 20, 21 faces the at least one intermediate element portion (49, 50).

8 Claims, 3 Drawing Sheets

HAIR-CUTTING APPARATUS HAVING A TOOTHED CUTTING DEVICE, AND TOOTHED CUTTING DEVICE FOR A HAIR-CUTTING APPARATUS

FIELDS OF THE INVENTION

The invention relates to an apparatus for cutting hairs, having a toothed cutting device which comprises a first toothed cutter with a first cutter-tooth row, which extends in a tooth row direction and comprises a plurality of cutter teeth, and a second toothed cutter with a second cutter-tooth row, which also extends in the tooth row direction and comprises a plurality of cutter teeth, and in which: (1) both toothed cutters are reciprocatingly drivable relative to one another in accordance with a given stroke; (2) both toothed cutters lie against one another in the area of their cutter-tooth vows and (3) both toothed cutters have at least one supporting limb each in their areas which, in directions transverse to the tooth row direction, are remote from the cutter tooth rows, which supporting limbs face one another pairwise and each have a given dimension in the tooth row direction, and (4) one of the two toothed cutters carries an intermediate element of a low-friction material, which intermediate element comprises at least one intermediate element portion interposed between two facing supporting limbs, via which portion the at least one supporting limb of this one toothed cutter acts upon the at least one supporting limb of the other toothed cutter and has a given dimension in the tooth row direction.

The invention further relates to a toothed cutting device for an apparatus for cutting hairs, which toothed cutting device comprises a first toothed cutter with a first cutter-tooth row, which extends in a tooth row direction and comprises a plurality of cutter teeth, and a second toothed cutter with a second cutter-tooth row, which also extends in the tooth row direction and comprises a plurality of cutter teeth, and in which: (1) both toothed cutters are reciprocatingly drivable relative to one another in accordance with a given stroke and in (2) both toothed cutters lie against one another in the area of their cutter-tooth rows (3) both toothed cutters have at least one supporting limb each in their areas which, in directions transverse to the tooth row direction, are remote from the cutter tooth rows, which supporting limbs face one another pairwise and each have a given dimension in the tooth row direction, and (4) of the two toothed cutters carries an intermediate element of a low-friction material, which intermediate element comprises at least one intermediate element portion interposed between two facing supporting limbs, via which portion the at least one supporting limb of this one toothed cutter acts upon the at least one supporting limb of the other toothed cutter and has a given dimension in the tooth row direction.

BACKGROUND OF THE INVENTION

An apparatus of the type defined in the first paragraph and a toothed cutting device of the type defined in the second paragraph are known, for example, from the document DE 26 46 818 A1. In the known apparatus and in the known toothed cutting device the two toothed cutters each have a single supporting limb in their areas which are remote from the rows of cutter teeth in directions transverse to the tooth row direction, which limbs have exactly the same dimension in the tooth row direction, which dimension corresponds to the overall length of each of the two cutters. In the known apparatus and in the known toothed cutting device the intermediate element of a low-friction material is connected to the non-drivable toothed cutter, which is stationary in operation. The intermediate element consists of a synthetic material. Owing to the fact that in the known apparatus and in the known toothed cutting device the intermediate element carried by one toothed cutter, i.e. the stationary toothed cutter, and the supporting limb of the other toothed cutter, i.e. the drivable toothed cutter, have the same dimensions in the tooth row direction, the successively recurring situation arises that in operation each of the two end portions of the supporting limb, which are spaced apart in the tooth row direction, come into contact with the intermediate element carried by the stationary toothed cutter, and is subsequently moved over the intermediate element up to and beyond the end of this element. This process leads to abrasion of the intermediate element by the end portions of the supporting limb of the drivable toothed cutter, as a result of which the toothed cutting device becomes soiled in the area of the two supporting limbs and the intermediate element, which abraded material may get between the intermediate element carried by the stationary toothed cutter and the supporting limb of the drivable toothed cutter, which gives rise to an undesirable increase of the friction between the intermediate element and the supporting limb of the drivable toothed cutter. Moreover, as a result of the abrasion of the intermediate element at its two ends the surface pressure between the intermediate element and the supporting limb of the drivable toothed cutter in the central area of these two parts of the toothed cutting device increases comparatively strongly, which also gives rise to an undesirable increase of the friction between these two parts.

SUMMARY OF THE INVENTION

An object of the invention is to preclude the above problems and to improve an apparatus of the type defined in the first paragraph and a toothed cutting device of the type defined in the second paragraph and provide an improved apparatus and a toothed cutting device, in which the friction between the intermediate element carried by one of the two toothed cutters and the supporting limb of the other one of the two toothed cutters does not increase even after a long time of use.

According to the invention, in order to achieve the above object an apparatus of the type defined in the first paragraph is characterized in that the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion. As a result of these measures in accordance with the invention, it is achieved in a very simple manner and without any additional investment, i.e. at low cost, that during operation of the apparatus the ends of a supporting limb of a toothed cutter do not come into contact with an intermediate element portion of the intermediate element carried by a toothed cutter or, if there is contact, it is only to such a small extent that no abrasion of an intermediate element portion by the free ends of a supporting limb occurs. Consequently there is no abraded material of the intermediate element and thus no soiling of the toothed cutting device in the area of an intermediate element portion and of the supporting limb lying at the intermediate element portion. Thus possible drawbacks which would lead to an increased friction between a portion of the intermediate element and a supporting limb which cooperates with such a portion of the intermediate element are precluded.

In an apparatus in accordance with the invention having a toothed cutting device which comprises a first toothed cutter with a first cutter-tooth row, which extends in a tooth row direction and comprises a plurality of cutter teeth, and a second toothed cutter with a second cutter-tooth row, which also extends in the tooth row direction and comprises a plurality of cutter teeth, and in which both toothed cutters are reciprocatingly drivable relative to one another in accordance with a given stroke, in which both tooted cutters lie against one another in the area of their cutter-tooth rows, in which both toothed cutters have at least one supporting limb each in their areas which, in directions transverse to the tooth row direction, are remote from the cutter tooth rows, which supporting limbs face one another pairwise and each have a given dimension in the tooth row direction, and in which one of the two toothed cutters carries an intermediate element of a low-friction material, which intermediate element comprises at least one intermediate element portion interposed between two facing supporting limbs, via which portion the at least one supporting limb of this one toothed cutter acts upon the at least one supporting limb of the other toothed cutter and has a given dimension in the tooth row direction, and wherein the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion, it has further proved to be advantageous if, in addition, the at least one intermediate element portion of the intermediate element carried by one of the two toothed cutters has a dimension in the toothed cutter direction which is smaller by an amount equal to at least the stroke between the two toothed cutters than the at least one supporting limb of the other one of the two toothed cutters, which last-mentioned supporting limb faces the at least one intermediate element portion. This absolutely assures that abrasion of an intermediate element portion by the end portions of a supporting limb which cooperate with such an intermediate element portion is prevented.

In an apparatus in accordance with the invention features, it has further proved to be advantageous if, in addition, the intermediate element mainly consists of a polyamide in which silicon and polytetrafluoroethylene have been embedded. Tests have proved that such a construction of an intermediate element is particularly advantageous in comparison with intermediate elements of other materials because very low friction values have been obtained with such an intermediate element. It is to be noted that such an intermediate element may also be used in an apparatus in accordance with the invention wherein at least one intermediate element portion of the intermediate element carried by one of the two toothed cutters has a dimension in the toothed cutter direction which is smaller by an amount equal to at least the stroke between the two toothed cutters than the at least one supporting limb of the other one of the two toothed cutters, which last-mentioned supporting limb faces the at least one intermediate element portion, as described above.

In an apparatus in accordance with the invention it has further proved to be advantageous if, in addition, the two toothed cutters each have two supporting limbs which are spaced apart in the tooth row direction. In comparison with a construction using a single supporting limb for each toothed cutter, such a construction has proved to be advantageous because lower friction values can be obtained with two comparatively short supporting limbs for each toothed cutter, which limbs are spaced apart in the tooth row direction. The feature wherein two toothed cutters each have two supporting limbs which are spaced apart in the tooth row direction may also be used in combination with any of the features described above.

In an apparatus in accordance with the invention having the characteristic features, wherein two toothed cutters each have two supporting limbs which are spaced apart in the tooth row direction, it has further proved to be advantageous if, in addition, the intermediate element is substantially U-shaped and comprises two intermediate element limbs, which extend substantially perpendicularly to the tooth row direction, and an intermediate element base, which extends substantially parallel to the tooth row direction and which interconnects the two intermediate element limbs, and the free end portions of the two intermediate element limbs are each interposed as intermediate element portions between two respective supporting limbs. Such a construction has proved to be advantageous for a highly simple mounting of the intermediate element portions between two facing pairs of supporting limbs.

In such an apparatus as just described, it has further proved to be advantageous if, in addition, the two intermediate element limbs of the U-shaped intermediate element are each integrally connected to a substantially U-shaped holder, in such a manner that a passage is formed between each of the intermediate element limbs and the holder which is integrally connected to the respective limb, and each passage is engaged by a supporting limb of the toothed cutter carrying the intermediate element, in order to hold the intermediate element. This guarantees that the intermediate element can be secured to the toothed cutter to be provided with the intermediate element.

According to the invention, in order to achieve the aforementioned object a toothed cutting device of the type defined in the second paragraph is characterized in that the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion. Thus, for a toothed cutting device in accordance with the invention advantages are obtained which correspond to the advantages set forth hereinbefore for an apparatus in accordance with the invention having the characteristic features defined in the first paragraph.

The advantageous variants of a toothed cutting device in accordance with the invention, include the following embodiments:

(1) an apparatus wherein the at least one intermediate element portion of the intermediate element carried by one of the two toothed cutters has a dimension in the toothed cutter direction which is smaller by an amount equal to at least the stroke between the two toothed cutters than the at least one supporting limb of the other one of the two toothed cutters, which last-mentioned supporting limb faces the at least one intermediate element portion; and/or (2) wherein the intermediate element mainly consists of a polyamide in which silicon and polytetrafluoroethylene have been embedded; and/or (3) wherein the two toothed cutters each have two supporting limbs which are spaced apart in the tooth row direction; and/or (4) wherein the intermediate element is substantially U-shaped and comprises two intermediate element limbs, which extend substantially perpendicularly to the tooth row direction, and an intermediate element base, which extends substantially parallel to the tooth row direction and which interconnects the two intermediate element limbs, and the free end portions of the two intermediate element limbs are each interposed as intermediate element portions between two respective supporting limbs; and/or (5) wherein the two intermediate element limbs of the U-shaped intermediate element are each integrally connected to a substantially U-shaped holder, in such a manner that a passage is formed between each of the intermediate element limbs and the holder which is integrally connected to the respective limb, and each passage is engaged by a supporting limb of the toothed cutter carrying the intermediate element, in order to hold the intermediate element.

The afore-mentioned aspects as well as further aspects of the invention will be apparent from the embodiments described hereinafter by way of examples and will be elucidated by means of these embodiments.

The invention will now be described in more detail with reference to an embodiment shown in the drawings given by way of example, but to which the invention is not limited.

Figure 1:
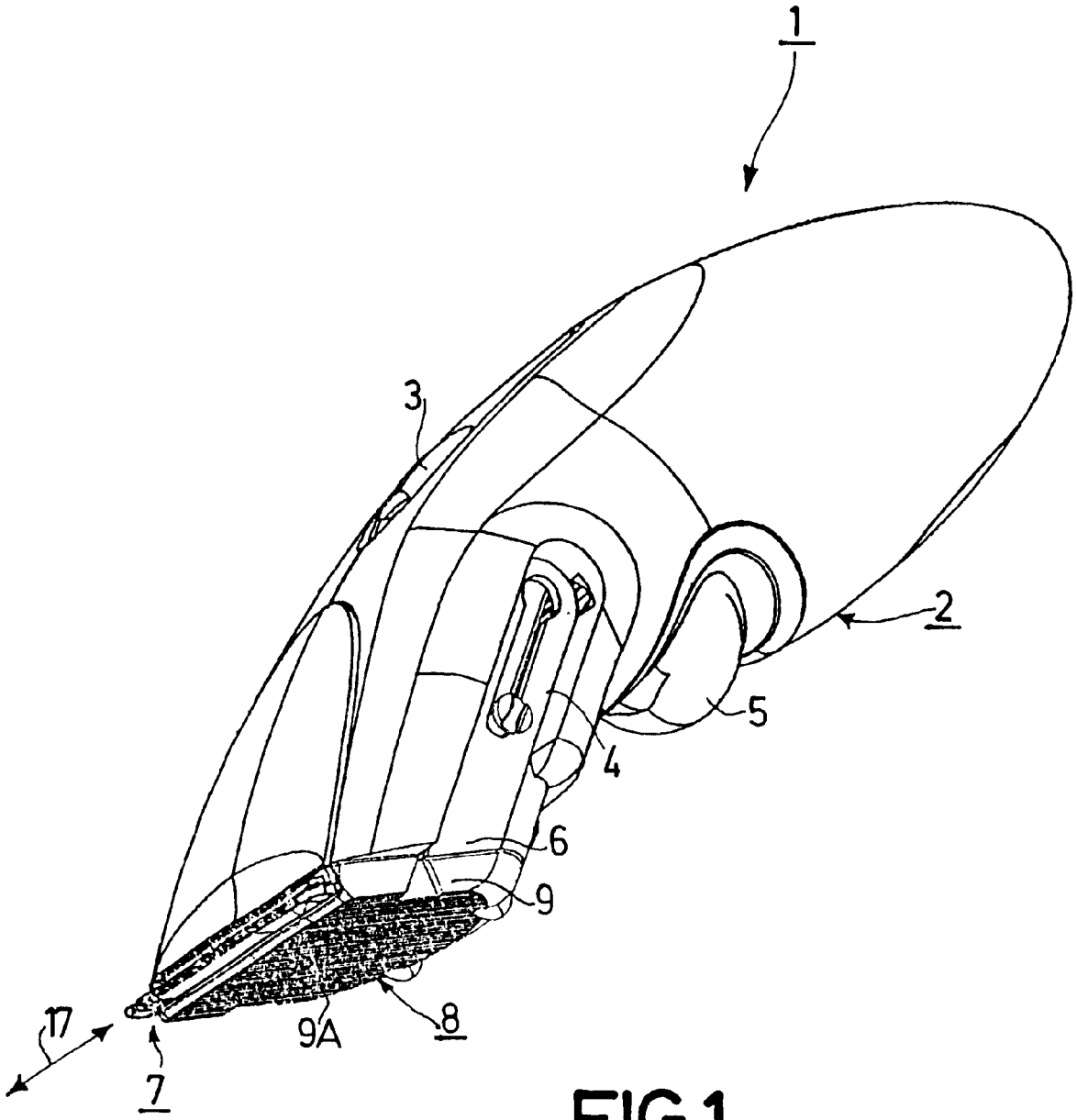
FIG. 1 is an oblique view of a hair-cutting apparatus in accordance with the invention provided with a toothed cutting device at one end face.

FIG. 1 shows an apparatus 1 for cutting hairs, which is often also referred to as a hair trimmer. The apparatus 1 has a housing 2 which has been given a curved or angled shape in order to achieve an ergonomically favorable construction. In a dorsal area of the housing 2 a button 3 has been arranged, which button is slidable between a plurality of positions and which can be actuated to adjust a comb attachment, not shown, for the apparatus 1 between a plurality of different positions. The housing 2 of the apparatus 1 has two guideways adapted to receive guide members of such a comb attachment, of which only one guideway 4 is visible in FIG. 1. In a ventral area of the housing 2 a further slide button 5 has been arranged, which is an on/off button which is slidable between two switch positions. By means of the further slide button 5 an electric drive motor accommodated in the housing 2 of the apparatus 1 can be switched on and switched off. The drive motor is adapted to drive a drive mechanism whose function will be described briefly hereinafter.

At the location of an end portion 6 of the housing 2 the apparatus 1 comprises a toothed cutting device 7. The construction of the toothed cutting device 7 will be described in detail hereinafter with reference to FIGS. 2, 3 and 4.

The toothed cutting device 7 comprises a cutter support 8 made of a synthetic material. The cutter support 8 has a substantially plate-shaped base 9 whose flat outer surface 9A may be placed onto the skin of a user during use of the apparatus 1. Three positioning projections 10, 11 and 12 project from the inner side of the base 9. A first toothed cutter 13 can be mounted onto these three positioning projections 10, 11 and 12, the positioning projections 10, 11 and 12 then engaging three positioning holes 14, 15 and 16 of the first toothed cutter 13. In this way, the first toothed cutter 13 is stationarily mounted on the base 9 by means of the positioning projections 10, 11 and 12. Thus, the first toothed cutter 13 is a stationary toothed cutter, which is stationary during operation of the apparatus 1 and the toothed cutting device 7.

Figure 2:
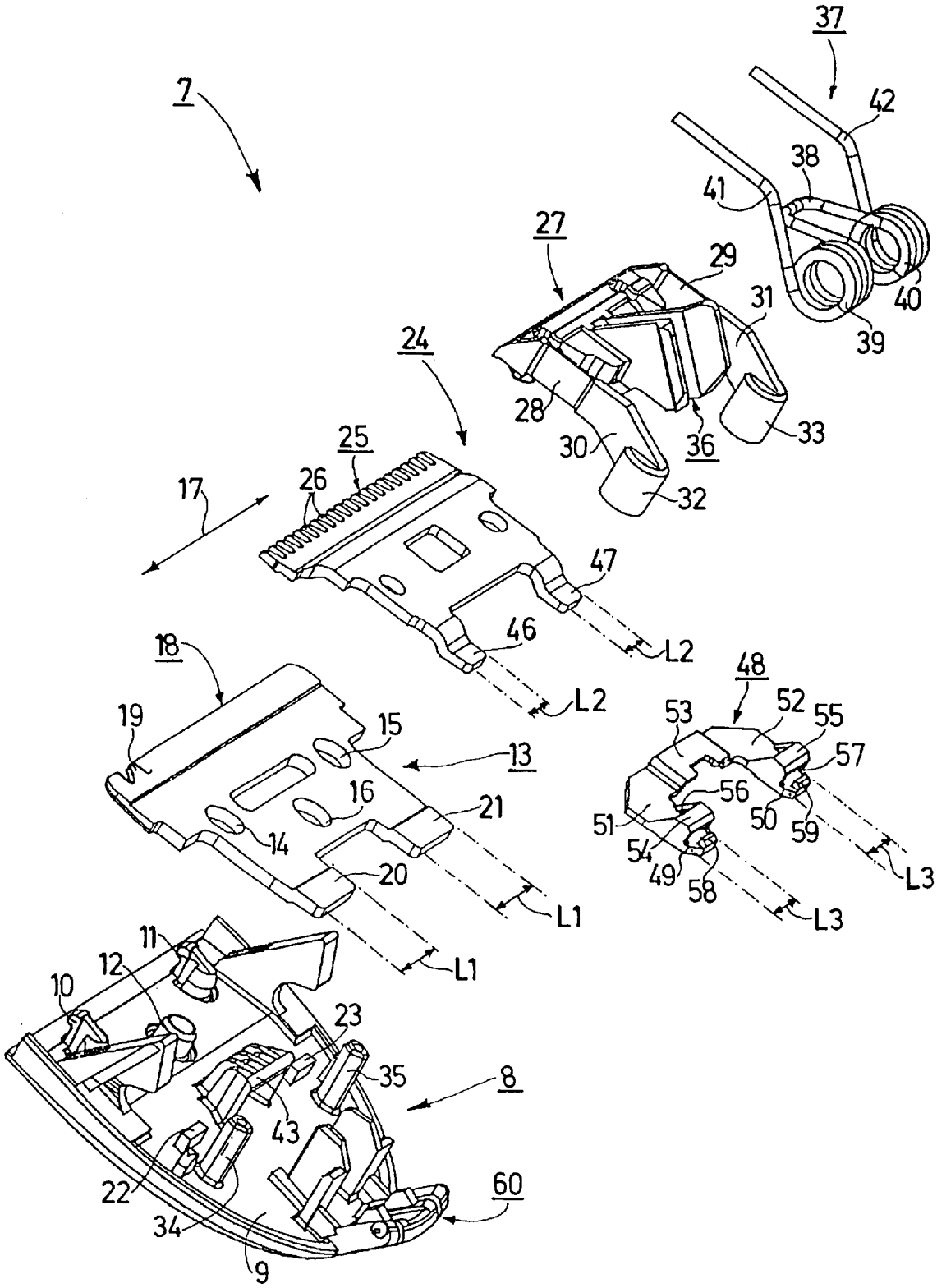
FIG. 2 is an exploded view of the toothed cutting device of the apparatus of FIG. 1.
Figure 3:
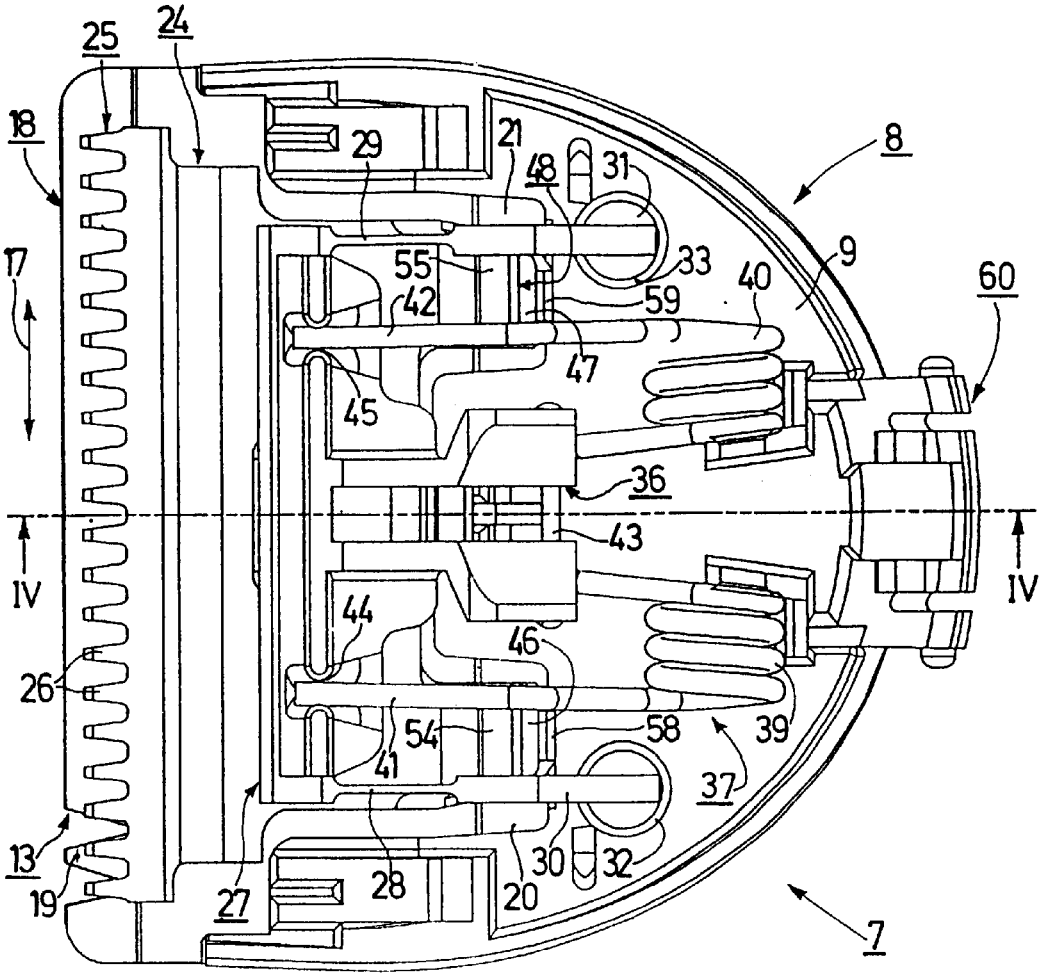
FIG. 3 is a plan view of the toothed cutting device of the apparatus of FIG. 1 in its assembled condition.
Figure 4:
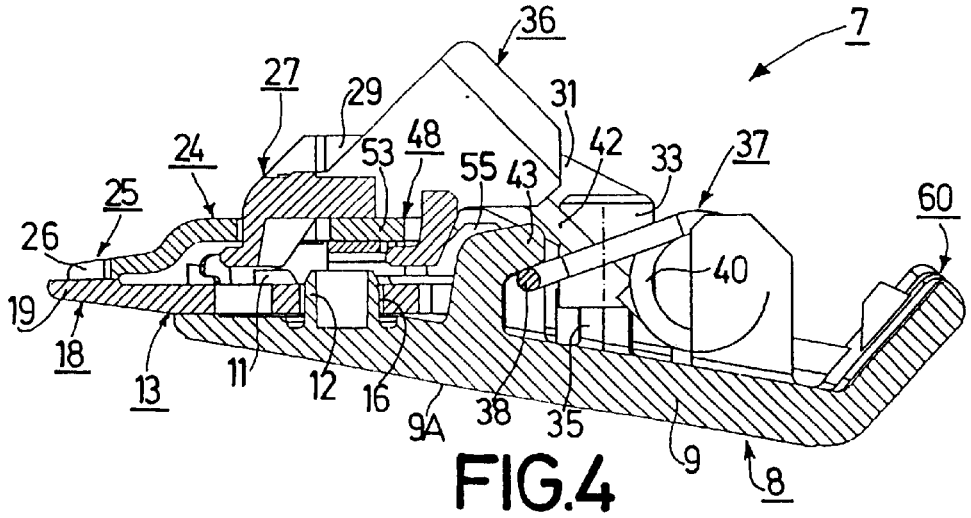
FIG. 4 shows the toothed cutting device of FIG. 1 in a sectional view taken on the line IV—IV in FIG. 3.

The first toothed cutter 13 is made of steel, preferably chrome-steel, and has a cutter-tooth row 18, which extends in a tooth row direction indicated by a double arrow 17 in FIGS. 2 and 3 and which comprises a plurality of cutter teeth 19, FIGS. 2 and 3 showing only one of said cutter teeth 19 for the sake of simplicity. In its area which, in a direction transverse to the cutter tooth direction 17, is remote from the cutter-tooth row 18 the first toothed cutter 13 comprises two supporting limbs 20 and 21 which are spaced apart in the cutter tooth direction 17. In the assembled condition of the toothed cutting device 7 the supporting limbs 20 and 21 each bear on a supporting block 22 and 23, respectively. The two supporting blocks 22 and 23 project from the base 9 of the cutter support 8. In the tooth row direction 17 the two supporting limbs 20 and 21 of the first toothed cutter 13 have a given dimension, i.e. the length L1, as is indicated in FIG. 2.

The toothed cutting device 7 comprises a second toothed cutter 24. The second toothed cutter 24 is also made of steel, for example chrome-steel and comprises a second cutter-tooth row 25, which also extends in the tooth row direction 17 and has a plurality of cutter teeth 26. The second toothed cutter 24 is fixedly connected to a reciprocating bridge 27 made of a synthetic material and integrally connected to two mounting arms 30 and 31 via two integral hinges 28 and 29. The mounting arms 30 and 31 each have a substantially semicircular end portion 32 and 33, respectively. By means of the two end portions 32 and 33 the two mounting arms 30 and 31 are connected to two mounting projections 34 and 35, which project from the base 9 of the cutter support 8. The reciprocating bridge 27 further comprises a driving fork 36 in which a drive member of the afore-mentioned drive mechanism of the apparatus 1 engages, which drive mechanism can be driven by the electric drive motor of the apparatus 1. The reciprocating bridge 27 can thus be driven by the drive motor of the apparatus 1. When the reciprocating bridge 27 is driven the bridge 27 performs a reciprocating motion which is oriented substantially in the tooth row direction, the mounting arms 30 and 31 being stationary and the movability of the reciprocating bridge 27 being provided by the integral hinges 28 and 29. By means of the reciprocating bridge 27 the second toothed cutter 24, which is fixedly connected to this bridge, is reciprocatingly drivable relative to the stationary first toothed cutter 13 with a given stroke H. The stroke H can have a value of, for example, H=2.8 mm.

The toothed cutting device 7 further comprises a spring device 37 manufactured from a wire material and made of steel, preferably chrome-nickel steel but, alternatively, of spring bronze. The spring device 37 comprises a substantially U-shaped central portion 38 and two wound spring portions 39 and 40, which adjoin the two limbs of the U-shaped central portion 38 and comprise a plurality of turns, as well as two bent end portions 41 and 42 which project from the respective spring portions 39 and 40. The spring device 37 is constructed in such a manner that the central portion 38, on the one hand, and the two end portions, on the other hand, tend to move towards one another. The central portion 38 of the spring device 37 is accommodated in a holder 43 which projects from the base 9 of the cutter support 8. The two end portions 41 and 42 act on the reciprocating bridge 27, the free ends of the two end portions 41 and 42 engaging in slots 44 and 45 in the reciprocating bridge 27, as can be seen in FIG. 3. By means of the spring device 37, whose central portion 38 is accommodated in the holder 43 of the base 9 of the cutter support 8 and whose end portions 41 and 42 engage in slots 44 and 45 in the reciprocating bridge 27, the two toothed cutters 13 and 24 are pressed towards one another with a given spring force, as a result of which the two toothed cutters 13 and 24 lie against one another in the area of their cutter-tooth rows 18 and 25.

Similarly to the first toothed cutter 13, the second toothed cutter 24 comprises two supporting limbs 46 and 47 which are spaced apart in the cutter tooth direction 17. In the tooth row direction 17 the two supporting limbs 46 and 47 each have a given dimension, i.e. the length L2, as is indicated in FIG. 2. The supporting limbs 20 and 21 of the first toothed cutter 13 face the supporting limbs 46 and 47 of the second toothed cutter 24 pairwise, i.e. facing pairs being formed by the supporting limbs 20 and 46 and by the supporting limbs 21 and 47.

In the toothed cutting device 7 the second toothed cutter 24, i.e. the reciprocatingly drivable toothed cutter 24, of the two toothed cutters 13 and 24 carries an intermediate element 48 of a low-friction material. The intermediate element 48 comprises two intermediate element portions 49 and 50 interposed respectively between two facing supporting limbs 20, 46 and 21, 47. The supporting limbs 46 and 47 of the second toothed cutter 24 respectively act upon the facing supporting limbs 20 and 21 of the first toothed cutter 13 via the respective intermediate element portions 49 and 50. The two intermediate element portions 49 and 50 also have a given dimension in the tooth row direction 17, i.e. the length L3, as is indicated in FIG. 2.

In the apparatus 1, i.e. in the toothed cutting device 7 of the apparatus 1, the construction is advantageously devised in such a manner that each of the two intermediate element portions 49 and 50 of the intermediate element 48 carried by the second toothed cutter 24 has a smaller dimension in the tooth row direction 17 than the respective supporting limb 20 or 21 of the first toothed cutter 13 facing the relevant intermediate element portion 49 or 50. In the present case the two lengths L1 and L3 have been selected in such a manner that the dimension in the tooth row direction 17 of each of the two intermediate element portions 49 and 50 of the intermediate element 48 carried by the second toothed cutter 24 is smaller than the supporting limb 20 or 21 of the first toothed cutter 13 which faces the relevant intermediate element portion 49 or 50 by an amount equal to at least the stroke H between the two toothed cutters 13 and 24. In the case of a stroke H of the second toothed cutter 24 relative to the first toothed cutter 13 of, for example, H=2.8 mm the length L1 of the two supporting limbs 20 and 21 can be, for example, 8.0 mm and the length L3 can be, for example, 5.2 mm. However, in the present example the length can alternatively be 8.2 mm or 8.5 mm. In the last-mentioned example the length L3 can alternatively be 5.0 mm or 4.7 mm. However, it is remarked explicitly that in said example with a length L1 of 8.0 mm and a hub of 2.8 mm the length L3 can also be 5.4 mm or even 5.6 mm without the advantages of the shorter dimension of the intermediate element portions 49 and 50 in relation to the supporting limbs 20 and 21 being lost.

With respect to the intermediate element 48 it is to be noted that this intermediate element 48 mainly consists of a polyamide in which silicon and polytetrafluoroethylene have been embedded. Such an intermediate element 48 exhibits particularly low friction values when its intermediate element portions 49 and 50 cooperate with the steel supporting limbs 20 and 21 of the first toothed cutter 13 made of steel. It is to be noted that it has proved to be very advantageous if the polyamide is polyamide 6.6. Furthermore, it has proved to be very advantageous if the intermediate element 48 consists mainly of polyamide, preferably polyamide 6.6, in which in addition to silicon and polytetrafluoroethylene glass beads, glass fibers or carbon fibers have been embedded.

It is to be noted also that the intermediate element 48 is substantially U-shaped and comprises two intermediate element limbs 51 and 52, which extend substantially perpendicularly to the tooth row direction 17, and an intermediate element base 53, which extends substantially parallel to the tooth row direction 17 and which interconnects the two intermediate element limbs 51 and 52. The free end portions of the two intermediate element limbs 51 and 52 are then each interposed as intermediate element portions 49 and 50 between, respectively, two supporting limbs 20 and 46 or 21 and 47. As is further apparent from FIG. 2, the two intermediate element limbs 51 and 52 of the U-shaped intermediate element 48 are each integrally connected to a substantially U-shaped holder 54 or 55, respectively, in such a manner that a passage 56 or 57 is formed between each of the intermediate element limbs 51 and 52 and the respective holder 54 or 55, which is integrally connected to the respective limb. Each passage 56 or 57 is engaged by a supporting limb 46 or 47 of the second toothed cutter 24 carrying the intermediate element 48 in order to hold the intermediate element 48. This construction has the advantage that the intermediate element 48 can simply be slid onto the two supporting limbs 46 and 47 of the second toothed cutter 24 in a direction transverse to the tooth row direction 17, the two supporting limbs 46 and 47 being passed through the two passages 56 and 57 until the free ends of the supporting limbs 46 and 47 abut against stops 58 and 59 which project from the intermediate element limbs 51 and 52 at the ends of these limbs.

For the sake of completeness, it is to be noted that at its end which is remote from the two tooth rows 18 and 25 the plate-shaped base 9 of the cutter support 8 carries a member 60 which in the area of its free end carries a part of a pivotal device, whose other end is arranged on the housing 2 of the apparatus 1. By means of this pivotal device the cutter support 8 and, consequently, the entire toothed cutting device 7 is pivotably connected to the housing 2. In this way, the toothed cutting device 7 can be pivoted away from the housing 2 from the operating position shown in FIG. 1, in which the toothed cutting device 7 has been swung down onto the housing 2 of the apparatus 1, into a cleaning position, not shown, in which the toothed cutters 13 and 24 as well as the other parts, such as the reciprocating bridge 27, are accessible to permit cleaning.

In the apparatus 1 described in the foregoing and the toothed cutting device 7 described in the foregoing it is achieved in a particularly simple manner and substantially without any additional means, that the intermediate element portions 49 and 50 of the intermediate element 48 are always wholly in contact with the supporting limbs 20 and 21 of the first toothed cutter 13, which prevents the supporting limbs 20 and 21 from causing abrasion of the intermediate element 48 in the area of the intermediate element portions 49 and 50. This precludes soiling of the toothed cutting device 7 in the area of the supporting limbs 20 and 21 as well as 46 and 47 and in the area of the intermediate element 48, i.e. of its intermediate element portions 49 and 50, by abraded material of the intermediate element, which has the advantage that the values of the friction between the intermediate element portions 49 and 50 and the supporting limbs 20 and 21 are maintained and an increase of the friction values is avoided, which guarantees a persistently smooth drive of the second toothed cutter 24 without the necessity of lubrication at the location of the supporting limbs even after a long operating time.

The invention is not limited to the embodiment of a hair-cutting apparatus described above by way of example. The measures in accordance with the invention can be applied with advantage to a beard trimmer but also to a shaving apparatus having a toothed cutting device. The measures in accordance with the invention can also be applied to an apparatus having a toothed cutting device whose two toothed cutters have only one supporting limb each. Moreover, it is possible that each of the two toothed cutters has, for example, three supporting limbs, the supporting limbs of the two toothed cutters facing one another pairwise. In the toothed cutting device 7 of the apparatus 1 in the embodiment described herein by way of example the separate cutter support 8 is made of a synthetic resin; however, this is not necessarily so because adjacent its tooth row the stationary toothed cutter can be of such a construction that at the same time it serves as a cutter support. In the toothed cutting device 7 of the apparatus 1 in the embodiment described herein by way of example the entire stationary toothed cutter 13 is made of steel; this is not necessarily so because the stationary toothed cutter can be made of steel only in the area of its cutter tooth row and adjacent the steel cutter part can consist of a further cutter part of a preferably dimensionally stable and comparatively hard synthetic resin, which further part is fixedly connected to the steel cutter part, the synthetic-resin further cutter part of the stationary toothed cutter having at least one supporting limb for cooperation with an intermediate element portion of an intermediate element carried by the drivable toothed cutter. Likewise, the synthetic-resin further cutter part may then at the same time act as the cutter support. In a further variant of an apparatus in accordance with the invention or a toothed cutting device in accordance with the invention the intermediate element can also be carried by the stationary toothed cutter, as is known per se from the document DE 26 46 818 A1.

What is claimed is:

1. An apparatus for cutting hairs, having a toothed cutting device which comprises a drive mechanism, a first toothed cutter with a first cutter-tooth row, which extends in a tooth row direction and comprises a plurality of cutter teeth, a second toothed cutter with a second cutter-tooth row, which also extends in the tooth row direction and comprises a plurality of cutter teeth, in which:

said first toothed cutter is reciprocatingly drivable relative to said second toothed cutter in accordance with a given stroke H, by a reciprocating bridge driven by said drive mechanism of the apparatus, both toothed cutters lie against one another in the area of their cutter-tooth rows, both toothed cutters have at least one supporting limb each in their areas which, in directions transverse to the tooth row direction, are remote from the cutter tooth rows, which supporting limbs face one another pairwise and each have a given dimension in the tooth row direction, one of the two toothed cutters carries an intermediate element of a low-friction material, which intermediate element comprises at least one intermediate element portion interposed between said two facing supporting limbs, via which portion the at least one supporting limb of this one toothed cutter acts upon the at least one supporting limb of the other toothed cutter and has a given dimension in the tooth row direction, wherein the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion.

2. An apparatus as claimed in claim 1, wherein the intermediate element mainly consists of a polyamide in which silicon and polytetrafluoroethylene have been embedded.

3. A toothed cutting device for an apparatus for cutting hairs, which toothed cutting device comprises a first toothed cutter with a first cutter-tooth row, which extends in a tooth row direction and comprises a plurality of cutter teeth, and a second toothed cutter with a second cutter-tooth row, which also extends in the tooth row direction and comprises a plurality of cutter teeth, in which:

said first toothed cutter is reciprocatingly drivable relative to said second toothed cutter in accordance with a given stroke H, by a reciprocating bridge driven by said drive mechanism of the apparatus, both toothed cutters lie against one another in the area of their cutter-tooth rows, both toothed cutters have two supporting limbs each in their areas which, in directions transverse to the tooth row direction, are remote from the cutter tooth rows, which supporting limbs face one another pairwise and each are spaced apart in the tooth row direction, one of the two toothed cutters carries an intermediate element of a low-friction material, which intermediate element comprises at least one intermediate element portion interposed between said two facing supporting limbs, via which portion at least one supporting limb of this one toothed cutter acts upon at least one supporting limb of the other toothed cutter and has a given dimension in the tooth row direction, wherein the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion.

4. An apparatus for cutting hairs, having a toothed cutting device which comprises a drive mechanism, a first toothed cutter with a first cutter-tooth row, which extends in a tooth row direction and comprises a plurality of cutter teeth, a second toothed cutter with a second cutter-tooth row, which also extends in the tooth row direction and comprises a plurality of cutter teeth, in which:

said first toothed cutter is reciprocatingly drivable relative to said second toothed cutter in accordance with a given stroke H, by a reciprocating bridge driven by said drive mechanism of the apparatus, both toothed cutters lie against one another in the area of their cutter-tooth rows, both toothed cutters have two supporting limbs each in their areas which, in directions transverse to the tooth row direction, are remote from the cutter tooth rows, which supporting limbs face one another pairwise and each are spaced apart in the tooth row direction, one of the two toothed cutters carries an intermediate element of a low-friction material, which intermediate element comprises at least one intermediate element portion interposed between said two facing supporting limbs, via which portion at least one supporting limb of this one toothed cutter acts upon at least one supporting limb of the other toothed cutter and has a given dimension in the tooth row direction, wherein the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion.

5. An apparatus as claimed in claim 4, wherein the intermediate element is substantially U-shaped and comprises two intermediate element limbs, which extend substantially perpendicularly to the tooth row direction, and an intermediate element base, which extends substantially parallel to the tooth row direction and which interconnects the two intermediate element limbs, and the free end portions of the two intermediate element limbs are each interposed as intermediate element portions between two respective supporting limbs.

6. An apparatus as claimed in claim 5, wherein the two intermediate element limbs of the U-shaped intermediate element are each integrally connected to a substantially U-shaped holder, in such a manner that a passage is formed between each of the intermediate element limbs and the holder which is integrally connected to the respective limb, and each passage is engaged by a supporting limb of the toothed cutter carrying the intermediate element, in order to hold the intermediate element.

7. A toothed cutting device for an apparatus for cutting hairs, which toothed cutting device comprises a drive mechanism, a first toothed cutter with a first cutter-tooth row, which extends in a tooth row direction and comprises a plurality of cutter teeth, and a second toothed cutter with a second cutter-tooth row, which also extends in the tooth row direction and comprises a plurality of cutter teeth, in which:

said first toothed cutter is reciprocatingly drivable relative to said second toothed cutter in accordance with a given stroke H, by a reciprocating bridge driven by said drive mechanism of the apparatus, both toothed cutters lie against one another in the area of their cutter-tooth rows, both toothed cutters have at least one supporting limb each in their areas which, in directions transverse to the tooth row direction, are remote from the cutter tooth rows, which supporting limbs face one another pairwise and each has a given dimension in the tooth row direction, one of the two toothed cutters carries an intermediate element of a low-friction material, which intermediate element comprises at least one intermediate element portion interposed between said two facing supporting limbs, via which portion the at least one supporting limb of this one toothed cutter acts upon the at least one supporting limb of the other toothed cutter and has a given dimension in the tooth row direction, wherein the at least one intermediate element portion of the intermediate element carried by one of the two toothed cutters has a smaller dimension in the toothed cutter direction than the at least one supporting limb of the other one of the two toothed cutters, which last-mentioned supporting limb faces the at least one intermediate element portion said smaller dimension being smaller by an amount at least equal to the stroke H.

8. A toothed cutting device as claimed in claim 7, wherein the intermediate element mainly consists of a polyamide in which silicon and polytetrafluoroethylene have been embedded.

* * * * *